United States Patent [19]

Morse

[11] Patent Number: 4,651,540

[45] Date of Patent: Mar. 24, 1987

[54] SUCTION ACCUMULATOR INCLUDING AN ENTRANCE BAFFLE

[75] Inventor: Robert L. Morse, Adrian, Mich.

[73] Assignee: Tecumseh Products Company, Tecumseh, Mich.

[21] Appl. No.: 842,493

[22] Filed: Mar. 21, 1986

[51] Int. Cl.[4] ..... F25B 43/00

[52] U.S. Cl. ..... 62/503; 55/192; 55/204; 55/441; 55/459 R

[58] Field of Search ..... 62/503; 55/192, 204, 55/441, 459 R

[56] References Cited

U.S. PATENT DOCUMENTS

| | | | |
|---|---|---|---|
| 421,017 | 2/1890 | Stein | 55/423 |
| 796,429 | 8/1905 | Huxley | 55/413 |
| 1,746,406 | 2/1930 | Sawyer | 62/503 |
| 1,978,463 | 10/1934 | Kettering | 62/115 |
| 2,402,845 | 6/1946 | Rodman | 183/106 |
| 2,691,873 | 10/1954 | Skoli et al. | 62/503 |
| 3,020,729 | 2/1962 | Brandin | 62/503 |
| 3,084,523 | 4/1963 | Bottum et al. | 62/296 |
| 3,163,998 | 1/1965 | Wile et al. | 62/278 |
| 3,200,568 | 8/1965 | McNeil | 55/191 |
| 3,283,524 | 11/1966 | Byron | 62/115 |
| 3,370,440 | 2/1968 | Kellie | 62/503 |
| 3,429,139 | 2/1969 | Wile et al. | 62/278 |
| 3,563,053 | 2/1971 | Bottum | 62/503 |
| 3,643,465 | 2/1972 | Bottum | 62/503 |
| 3,698,207 | 10/1972 | Melnyk | 62/503 |
| 3,837,177 | 9/1974 | Rockwell et al. | 62/503 |
| 3,872,689 | 3/1975 | Bottum | 62/503 |
| 4,009,596 | 3/1977 | Morse | 62/503 |
| 4,094,165 | 6/1978 | Sisk | 62/503 |
| 4,111,005 | 9/1978 | Livesay | 62/503 |
| 4,182,136 | 1/1980 | Morse | 62/503 |
| 4,187,088 | 2/1980 | Hodgson | 55/169 |
| 4,194,370 | 3/1980 | Norse | 62/503 |
| 4,194,371 | 3/1980 | Morse | 62/503 |
| 4,199,960 | 4/1980 | Adams et al. | 62/503 |
| 4,208,887 | 6/1980 | Morse et al. | 62/503 |
| 4,212,653 | 7/1980 | Giles | 55/459 B |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,354,362 | 10/1982 | Schumacher et al. | 62/503 |
| 4,401,447 | 8/1983 | Huber | 55/387 |
| 4,474,035 | 10/1984 | Amin et al. | 62/503 |

*Primary Examiner*—Ronald C. Capossela

*Attorney, Agent, or Firm*—Jeffers, Irish & Hoffman

[57] ABSTRACT

A suction accumulator including a casing for defining a liquid storage vessel. The casing includes an upper and lower end cap. A baffle is disposed in an upper portion of the casing adjacent the upper end cap whereby refrigerant flowing into the inlet will be deflected by the baffle from an axial entry direction to flow in a horizontal plane and will be confined by the baffle until the fluid flows generally tangentially to the casing wall. At this point, the fluid leaves the baffle and flows into the liquid storage vessel. An elongated conduit is disposed in the casing whereby gaseous refrigerant flows through a tortuous path to enter the conduit and then flows through the conduit to the fluid outlet of the suction accumulator. The baffle and conduit may be molded or extruded from plastic material.

28 Claims, 13 Drawing Figures

SUCTION ACCUMULATOR INCLUDING AN ENTRANCE BAFFLE

BACKGROUND OF THE INVENTION

The present invention relates to a suction accumulator for a refrigeration system for separating liquid refrigerant from gaseous refrigerant, for storing the liquid refrigerant, and for providing a smooth flow of gaseous refrigerant to the suction line of a compressor More specifically, the present invention provides a suction accumulator of improved efficiency and reduced size as compared to prior art suction accumulators. Furthermore, the present invention provides a suction accumulator which is more economical to manufacture than prior art suction accumulators.

Closed loop refrigeration systems conventionally employ a refrigerant which is normally in the gaseous state wherein it may be compressed by means of a compressor. The refrigerant leaves the compressor at a relatively high pressure and is then routed through a condenser coil and an evaporator coil and back to the compressor for recompression. The refrigerant, under some circumstances such as startup of the refrigeration system, may be in its liquid state as it leaves the evaporator. Also, during certain running conditions, the evaporator may be flooded so that excess liquid refrigerant could enter the suction line and return to the compressor. If liquid refrigerant enters the suction side of the compressor, a "slugging" condition may occur whereby abnormally high pressures may result in the compressor which in turn may cause blown gaskets, broken valves, etc.

Accordingly, prior art suction accumulators have been provided which act as storage reservoirs for the liquid refrigerant and which prevent such liquid refrigerant from entering the compressor. Such prior art accumulators permit the liquid refrigerant to change to its gaseous state before entering the compressor. Numerous types of prior art accumulator structures have been provided such as, for instance, shown in U.S. Pat. Nos. 4,009,596; 4,182,136; 4,194,370; 4,194,371; and 4,208,887. In all of these suction accumulators, it is attempted to separate the gaseous refrigerant from the liquid refrigerant, to store the liquid refrigerant in a vessel, and to permit the gaseous refrigerant to flow through the vessel to an outlet and into the compressor suction port. Thus, the accumulator acts as a storage vessel for the liquid refrigerant which, in due course, evaporates to its gaseous state and is then permitted to enter the compressor. Conventionally, such accumulators will also provide a metering mechanism whereby the liquid refrigerant is metered into the outlet of the accumulator so that the flow of liquid refrigerant into the suction part of the compressor is regulated to prevent the aforementioned "slugging" problems.

Prior art accumulators have incorporated various types of deflectors or baffles to aid in separating the liquid refrigerant from the gaseous refrigerant. However, one problem with such prior art structures has been that the liquid refrigerant is not completely separated from the gaseous refrigerant so that some liquid refrigerant is allowed to enter the compressor suction inlet and thus resulting, under certain conditions, in the aforementioned "slugging" problems.

Another problem which has been encountered with such prior art suction accumulators has been that the pressure drop across the suction accumulator and in particular across the deflecting baffle of the suction accumulator is substantial. Such a pressure drop represents lost work and thus reduces the efficiency of the refrigeration system incorporating the suction accumulator which is, of course, undesirable.

A further problem with prior art suction accumulators has been that the inflowing refrigerant disturbs the liquid in storage and causes splashing of liquid into the outlet of the suction accumulator. Additionally, in some accumulators, the liquid in storage, at certain temperatures, has tended to separate into its oil and refrigerant components, thus causing a refrigerant-rich mixture to be supplied to the compressor and starving the compressor from lubricant. Such a condition could result in compressor bearing failures.

A still further problem with prior art suction accumulators has been their relatively large size It is preferable for an accumulator to be compact as, in certain applications, space is at a premium. Furthermore, Underwriter Laboratories specifies that for suction accumulator vessels larger than three inches in diameter a fusible plug is required thus resulting in a more costly structure. On the other hand, it has been difficult in prior art suction accumulators of three (3) inches or less in diameter accommodates to provide a large enough refrigerant mass flow rate. It is therefore desired to provide a suction accumulator which is smaller than three inches in diameter yet which accommodates a large mass flow rate. It is also desired to provide a suction accumulator with a simple yet effective pressure equalization system.

Yet another problem with prior art suction accumulators has been that they have been relatively expensive to construct. The prior art suction accumulators have generally been comprised of metal parts which needed to be assembled by soldering or brazing to form fluid tight seals. Thus, it is desired to provide a more economical suction accumulator which is less expensive to assemble than prior art suction accumulators.

SUMMARY OF THE INVENTION

The present invention overcomes the disadvantages of the above-described prior art suction accumulators by providing an improved suction accumulator therefor.

The suction accumulator according to the present invention, in one form thereof, comprises a generally cylindrical casing including top and bottom end walls and defining a liquid storage vessel. An inlet and an outlet for the vessel are provided in the top of the casing. A baffle is located in an upper portion of the vessel for deflecting and separating incoming refrigerant by imparting a generally spiralling motion to the refrigerant. The refrigerant is thus caused to swirl tangentially along the inside wall of the cylindrical casing. The gaseous refrigerant is conducted to the outlet while the liquid refrigerant is allowed to flow down the cylindrical casing wall to join the liquid refrigerant contained in the storage vessel.

The suction accumulator according to the present invention, in one form thereof, further comprises a generally cylindrical casing including two end walls. A fluid outlet is connected to a fluid flow conduit which is arranged axially in the cylindrical casing. A baffle located in a top portion of the casing surrounds the outlet and defines a confined, generally downwardly spiralling conduit for deflecting and imparting a spiralling motion to refrigerant which flows through an inlet into the casing. The refrigerant flows in a spiralling motion around the cylindrical wall of the casing whereby the liquid refrigerant will be separated from the gaseous refrigerant by centrifugal force and flows downwardly along the casing wall to join the liquid stored in the lower portion of the vessel. The gaseous refrigerant first flows upwardly through the vessel and then flows downwardly to enter a fluid flow conduit which conducts the gaseous refrigerant to the outlet of the vessel.

One advantage of a suction accumulator according to the instant invention is that it provides a very efficient and compact suction accumulator which is economical to construct.

Another advantage of the suction accumulator according to the present invention is that it accomplishes a positive change of direction for the incoming refrigerant from a vertical direction to a horizontal direction with a very small pressure drop.

Still another advantage of the suction accumulator according to the present invention is that it completely separates liquid refrigerant from the gaseous refrigerant and prevents liquid refrigerant from entering the suction line of the compressor.

A still further advantage of the instant invention is that it accomplishes smooth entry of the refrigerant into the liquid storage vessel without disturbance of the liquid which is in storage. This advantage is particularly significant during the valve reversal mode of a heat pump system.

A yet further advantage of the instant invention is that the swirling entry of the inflowing liquid into the liquid storage vessel imparts a swirling-mixing motion to the liquid which is in storage. This advantage is particularly important at low temperature operation when certain oils tend to phase separate from the liquid refrigerant. Thus, the liquid in storage will be separated into a refrigerant-rich layer on the bottom and an oil-rich layer on the top. The swirling motion imparted by the structure according to the instant invention is sufficient to maintain a homogeneous oil-refrigerant mixture.

Yet another advantage of the present invention is that it provides a suction accumulator with a simple but effective pressure equalization system.

The suction accumulator of the present invention, in one form thereof, comprises a casing including first and second end walls and defining a liquid storage vessel. A fluid inlet is provided in the casing for establishing a fluid flow path into the casing. A baffle is disposed in the casing for confining fluid which flows into the casing through the fluid inlet and for deflecting this fluid so that it flows tangentially to the wall of the casing and thereafter enters the liquid storage vessel.

The suction accumulator according to the present invention, in one form thereof, further comprises a cylindrical casing including first and second end walls and defining a liquid storage vessel. A fluid inlet is provided in the first end wall of the casing and a fluid outlet is also provided in the casing. A generally cylindrical baffle is provided in the casing for confining and deflecting fluid which flows into the casing through the inlet. The baffle defines a generally spiralling flow path whereby the fluid changes direction from a generally axial flow at the fluid inlet to a generally spiralling flow when the fluid flows from said baffle into the liquid storage vessel. An elongated conduit is axially disposed in the casing, the conduit being connected to a generally central portion of the baffle whereby fluid flows from the vessel through the elongated conduit and through the central portion of the baffle to the fluid outlet.

The suction accumulator according to the present invention, in one form thereof, still further provides a generally cylindrical casing including first and second end walls and defining a liquid storage vessel. A fluid inlet and a fluid outlet are provided in the first end wall. An elongated conduit is axially arranged in the casing and defines a downflow passage and an upflow passage. One end of the downflow passage is open to the vessel. The upflow and downflow passages are in fluid flow communication. The upflow passage is connected to the fluid outlet to establish a fluid flow path from the vessel to the outlet. A baffle is disposed in the casing, the baffle defining a confined fluid flow path and comprising a generally spiralling surface portion surrounding the fluid outlet, an arcuate upstanding outer wall and a generally spiralling inner wall. The baffle receives fluid flowing into the fluid inlet and deflects the fluid to flow substantially horizontally and tangentially to the inside wall of the casing. The arcuate outer wall of the baffle is spaced from the baffle inner wall whereby fluid flows from the baffle downwardly into the vessel.

The present invention, in one form thereof, also comprises a method for separating a refrigerant fluid into its liquid and gaseous components in a suction accumulator wherein the suction accumulator includes a casing having an inlet and an outlet. The method comprises directing refrigerant fluid through the inlet into the casing and deflecting the fluid to flow in a substantially spiralling path while confining the fluid for at least a portion of the spiralling path. The fluid is then separated into its liquid and gaseous components. The liquid component is collected and a flow path is provided to the outlet for the separated gaseous component.

It is an object of the present invention to provide an efficient and compact suction accumulator which is economical to construct and which effectively separates liquid refrigerant from gaseous refrigerant.

It is another object of the present invention to provide a suction accumulator wherein the pressure drop across the deflection baffle is small.

Still another object of the present invention is to provide a suction accumulator wherein smooth entry of gaseous and liquid refrigerant into the liquid storage vessel is accomplished with minimal disturbance of the stored liquid refrigerant and which imparts a swirling motion to the entering liquid to maintain a homogeneous oil and refrigerant mixture.

Yet another object of the present invention is to provide a suction accumulator wherein a tight seal between the baffle and the upper end wall of the casing is provided to prevent bypass of the baffle by refrigerant during high pressure conditions.

A still further object of the present invention is to provide for axial entry of the refrigerant into the suction accumulator casing and to smoothly deflect the refrigerant by means of a baffle with a minimal pressure drop whereby the refrigerant enters the liquid storage vessel tangentially to the cylindrical wall of the casing.

A yet further object of the present invention is to provide a suction accumulator with a simple yet effective pressure equalization system.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters represent corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
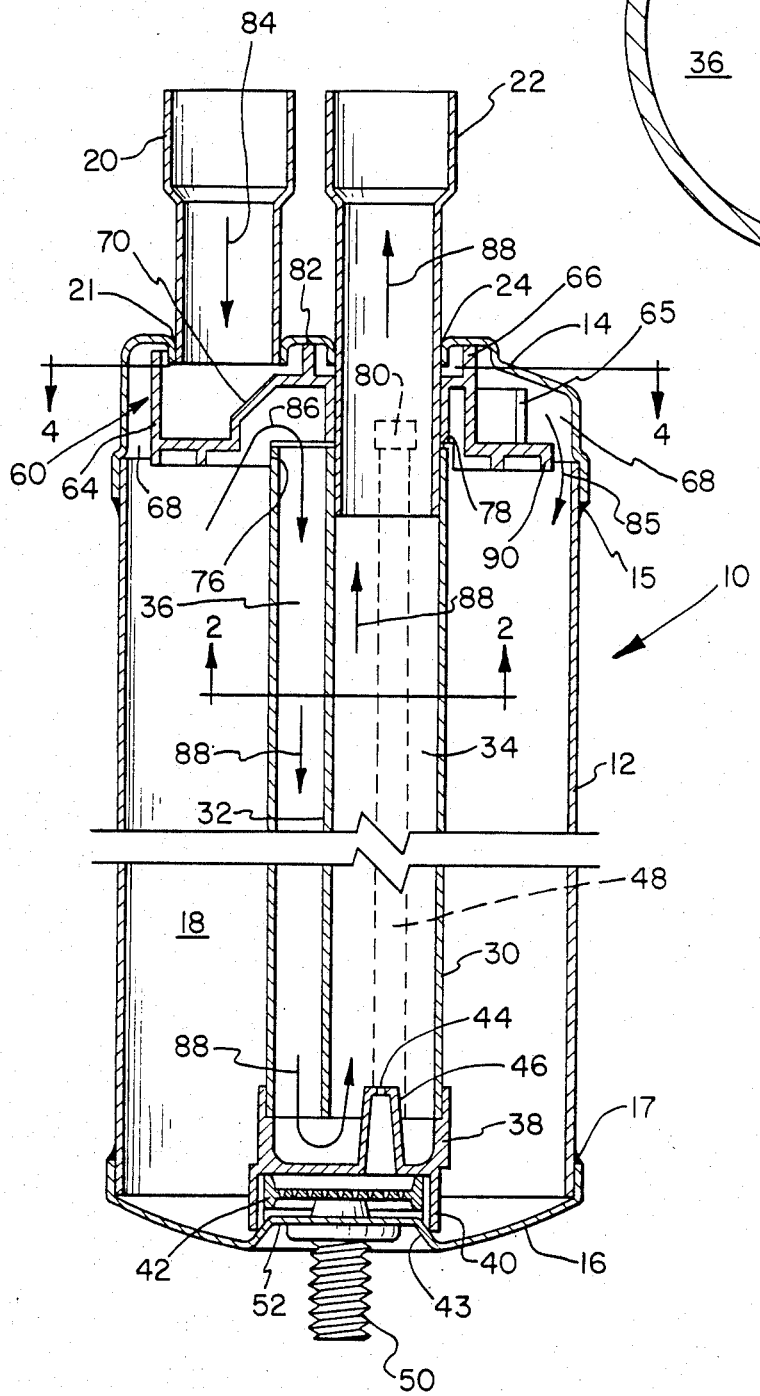
FIG. 1 is an elevational, sectional view of the suction accumulator according to the present invention.
Figure 2:
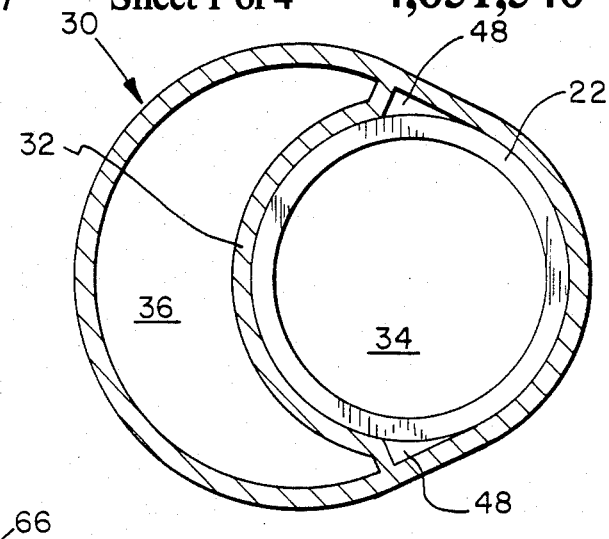
FIG. 2 is an enlarged view, in cross section, of the gaseous refrigerant conduit taken along line. 2—2 of FIG. 1.
Figure 5:
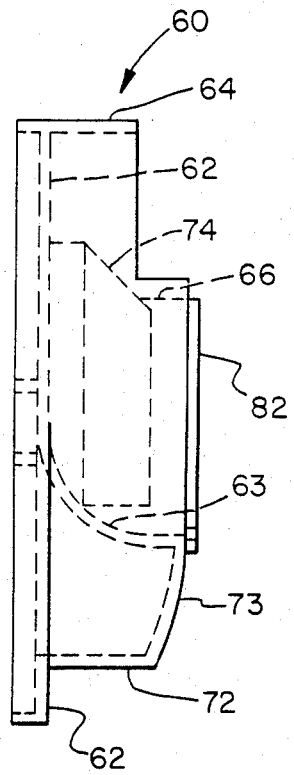
FIG. 5 is a side view of the deflection baffle of FIG. 3.

Referring to FIGS. 1 and 2, a suction accumulator 10 is shown including a cylindrical casing 12 having a top end wall 14 secured thereto by means of welding as at 15 or by any other suitable method. Casing 12 further includes a bottom end wall 16 which is secured to casing 12 by means of welding as at 17 or by any other suitable method. Thus, end walls 14 and 16 and casing 12 define a sealed liquid storage vessel.

Top end wall 14 includes a fluid inlet 20 sealingly secured to top end wall 14 by means of a brazed or soldered joint as at 21. Top end wall 14 further includes a fluid outlet 22 which is also secured to top end wall 14 by brazing as at 24 or by any other suitable method. An elongated conduit 30 is vertically arranged in vessel 18. Fluid outlet 22 is press fit into upflow passage 34. Conduit 30 includes a divider wall portion 32 to divide conduit 30 into an upflow passage 34 and a downflow passage 36. Conduit 30 is preferably made of extruded plastic material such as ULTEM 1000, manufactured by the General Electric of Mt. Vernon, Ind. A plastic transition cap 38 is sealingly secured to a lower end of conduit 30. Cap 38 may be secured to conduit 30 by plastic welding, an interference fit with an adhesive or any other suitable method. Transition cap 38 includes a spacer member 40 and a screen 42 disposed within spacer 40. Thus, conduit 30 and transition cap 38 are securely trapped between portion 43 of end wall 16 and fluid outlet 22. Transition cap 38 also includes a liquid conduit 46 extending generally upwardly from spacer 40. Liquid conduit 46 includes an orifice 44 which opens into the lower portion of upflow conduit 34. Transition cap 38, conduit 46, and spacer 40 are preferably molded as a unitary member from a plastic material such as, for instance, ULTEM 2300, manufactured by the General Electric of Mt. Vernon, Ind. The construction and operation of conduit 30 and transition cap 38 are further disclosed in copending U.S. patent application Ser. No. 842,311, filed on even date herewith and assigned to the same assignee as the present application which disclosure is incorporated herein by reference.

Conduit 30 also includes a pair of pressure equalization passages 48 whereby pressures occurring in the suction accumulator, under certain conditions, will be equalized. Such a condition may occur, for instance, when the compressor of the refrigeration system is turned off. If passages 48 were not provided, the pressures in the system would be able to build up under such conditions so that upflow passage 34 and downflow passage 36 would fill with liquid refrigerant which could then flow into the suction port of the compressor and cause "slugging" conditions when the compressor is again turned on. When the compressor shuts off, system pressure equalization commences. If the liquid refrigerant level in vessel 18 is above the bottom end of conduit 30, it will quickly seal off passages 34 and 36 by filling transition cap 38 via orifice 44. Without the provision of a pressure equalization passage, such as passages 48, the sealing of passages 34 and 36 in conduit 30 would interrupt the pressure equalization and the pressure differentials would force liquid refrigerant up conduit 38 and into the compressor thus resulting in compressor slugging upon start up. Equalization passages 48 must open into the upper end of vessel 18 so that only gas passes through passages 48 to allow pressure equalization to occur between the compressor and the refrigeration system. A liquid seal at the bottom of conduit 32 blocks off the normal equalization paths through passages 34 and 36, thus necessitating passages 48 or some other pressure equalization system. Thus, the use of passages 48 permits refrigerant gas to flow from vessel 18, through apertures 80 and passages 48 into the bottom inlet of upflow passage 34 and out of outlet 22. A threaded mounting stud 50 is also secured to an indented portion 52 of the lower end cap 16 whereby the suction accumulator may be mounted in an upright position in a refrigeration system.

Figure 3:
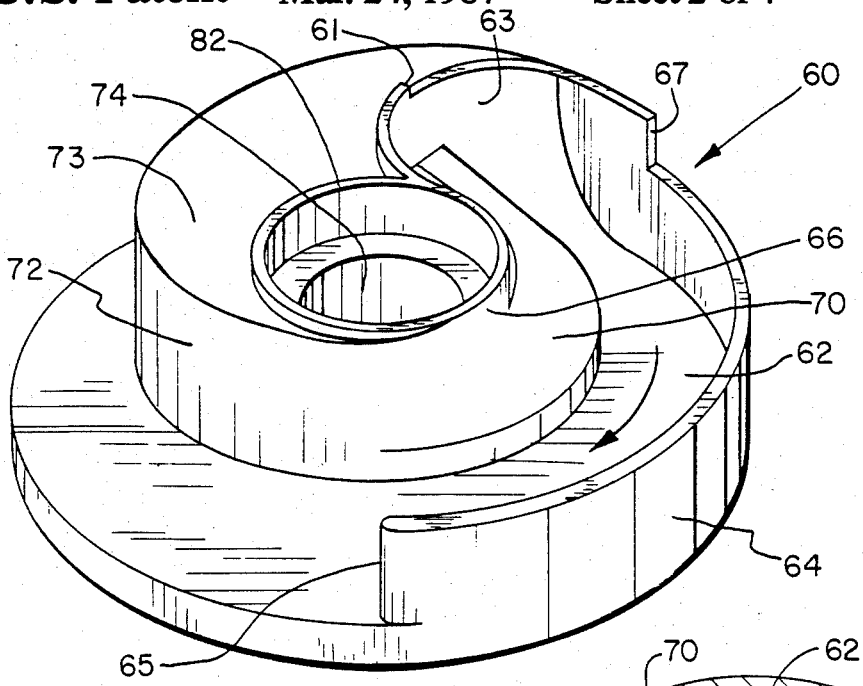
FIG. 3 is an enlarged perspective view of the deflection baffle.
Figure 4:
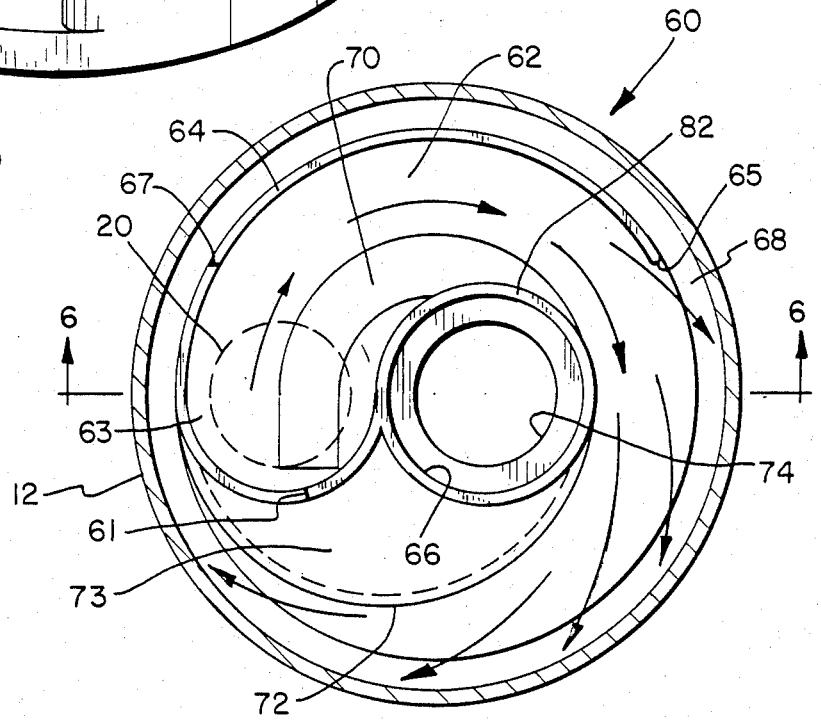
FIG. 4 is a view of the deflection baffle and accumulator casing of the suction accumulator taken along line 4—4 of FIG. 1.

Referring now to FIGS. 1-7, a deflection baffle 60 is shown including a spiralling ramp surface 62 and a sloping end portion 63 to provide entry to the ramp surface 62. As best seen in FIG. 4, sloping portion 63 is aligned with fluid inlet 20 which has been shown in dashed lines to show the relative position of fluid inlet 20 with respect to ramp entry portion 63. Wall 63 includes an upper edge which includes a stepped portion 61 and smoothly joins an arcuate wall 64. Arcuate wall 64 partially surrounds the baffle 60 and ends in an edge portion 65. Wall 64 also has a stepped portion 67 so that the top edge of wall 67 conforms to the inner surface of top end wall 14. Baffle 60 also includes a cylindrical wall portion 66 which aligns with and surrounds fluid outlet 22.

As best seen in FIGS. 1 and 4, in the assembled position of baffle 60 in casing 12, baffle 60 is spaced from the inner wall of casing 12 to form an annular space 68 between baffle 60 and casing 12. Thus, refrigerant entering inlet 20 will be deflected through 90° by sloping surface portion 63 of ramp surface 62 from the axial entry direction and will then flow down ramp 62 in spiral fashion until it reaches a position where the direction of fluid flow is tangential to the cylindrical wall of casing 12. This is approximately at the region just beyond edge portion 65 of arcuate wall 64. At this point, the refrigerant enters the annular space 68 between baffle 60 and cylindrical casing 12 and flows into the liquid storage volume portion of vessel 18.

Figure 6:
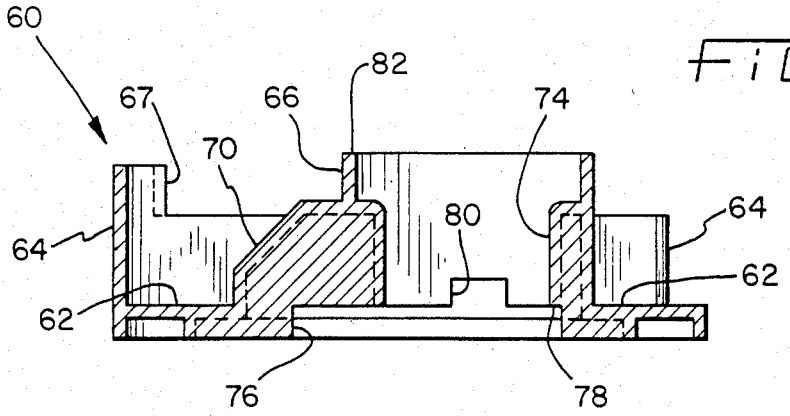
FIG. 6 is a view, in cross section, of the deflection baffle taken along line 6—6 of FIG. 4.
Figure 7:
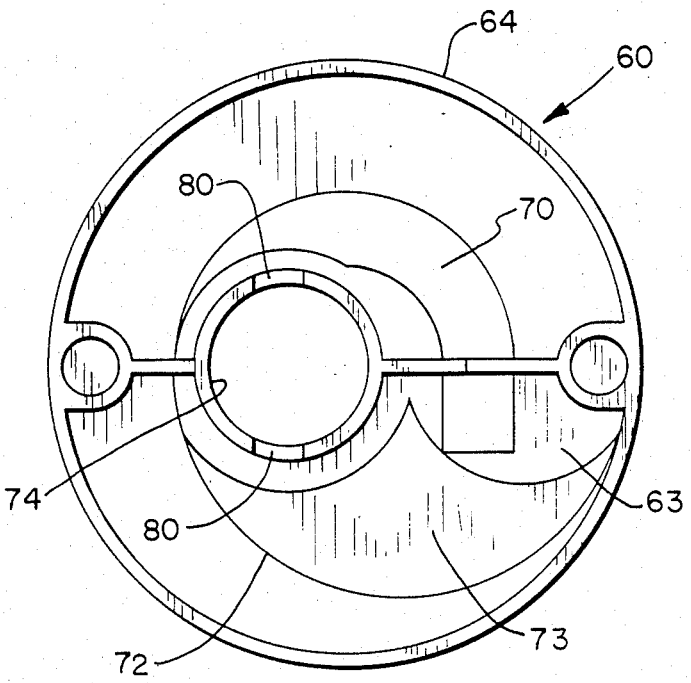
FIG. 7 is a bottom plan view of the deflection baffle of FIG. 3.
Figure 11:
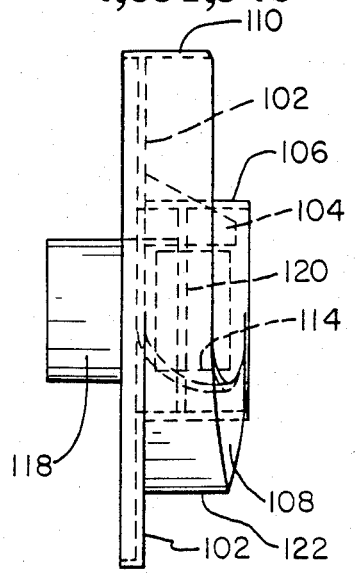
FIG. 11 is a side view of the deflection baffle of FIG. 9.
Figure 9:
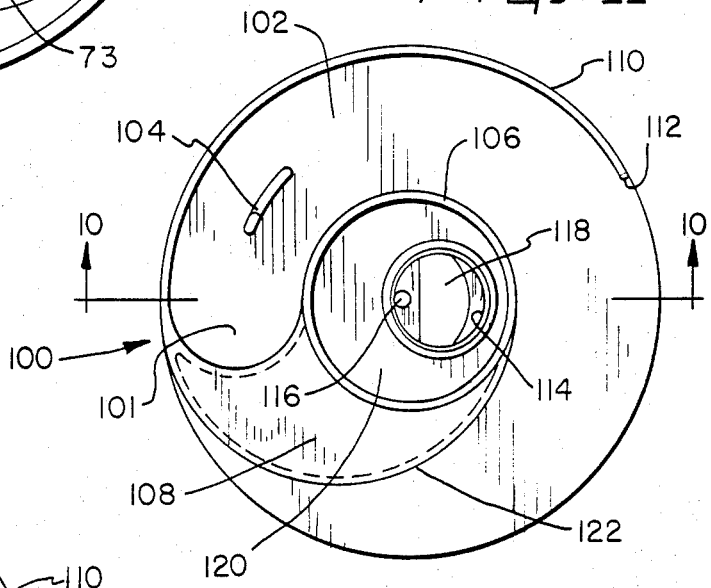
FIG. 9 is a top plan view of the deflection baffle according to the embodiment of FIG. 8.
Figure 12:
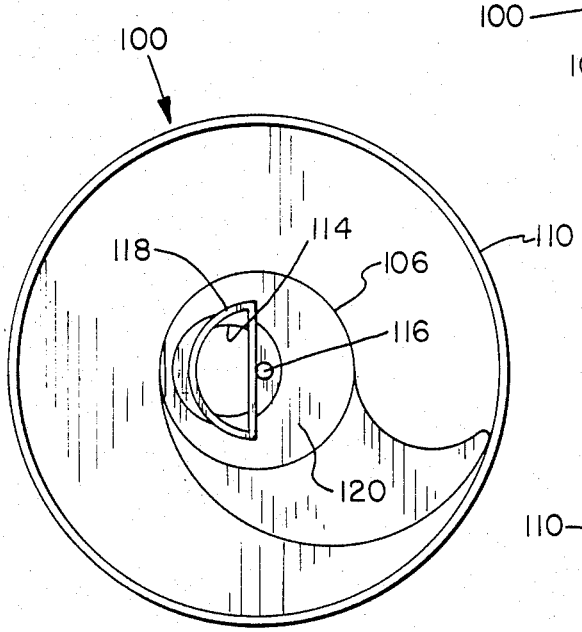
FIG. 12 is a bottom plan view of the deflection baffle of FIG. 9.
Figure 10:
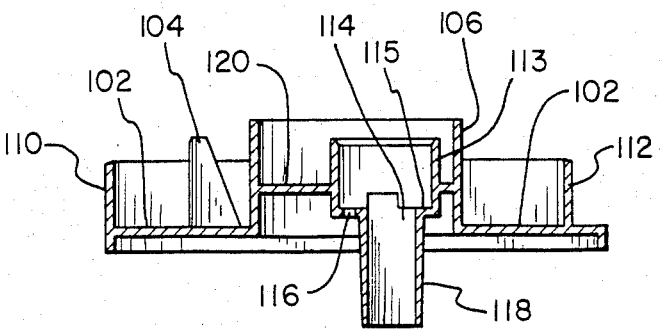
FIG. 10 is a view, in cross section, of the deflection baffle of FIG. 9 taken along line 10—10.
Figure 8:
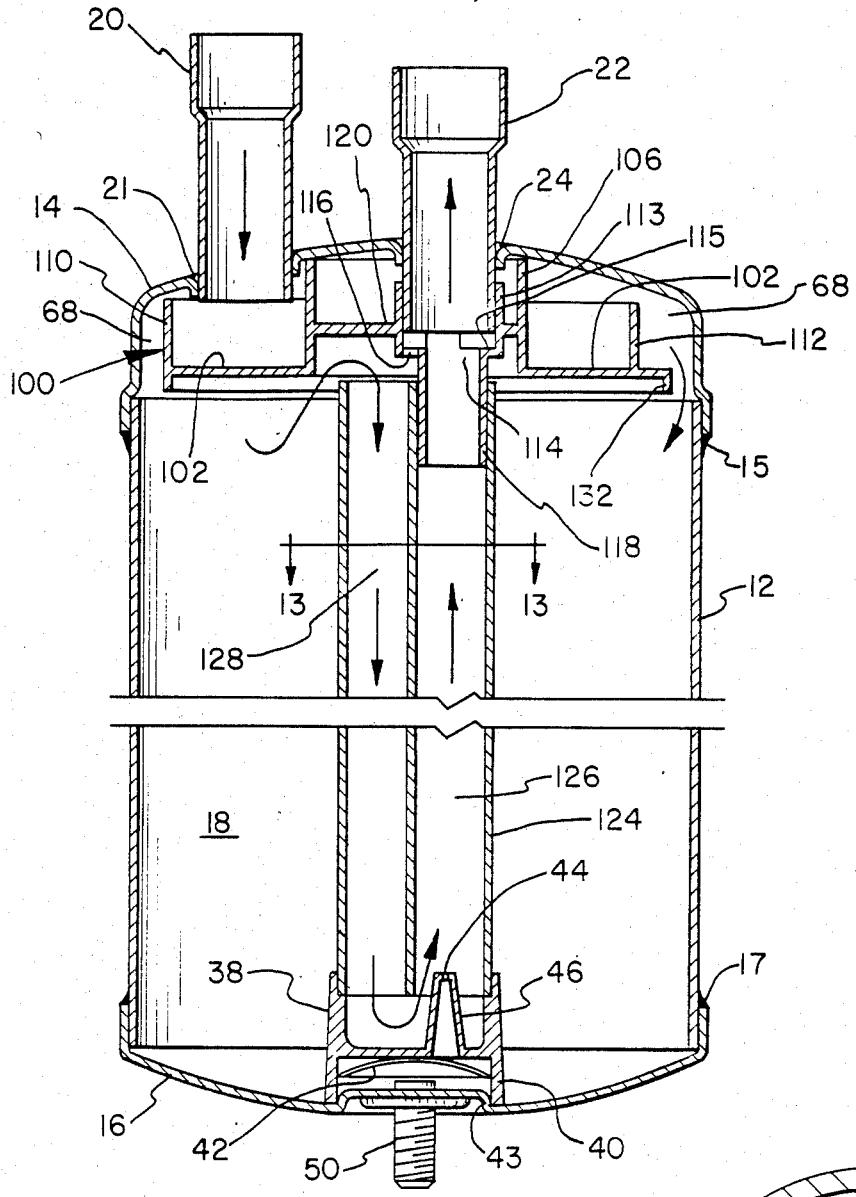
FIG. 8 is an elevational, sectional view of a suction accumulator according to another embodiment.
Figure 13:
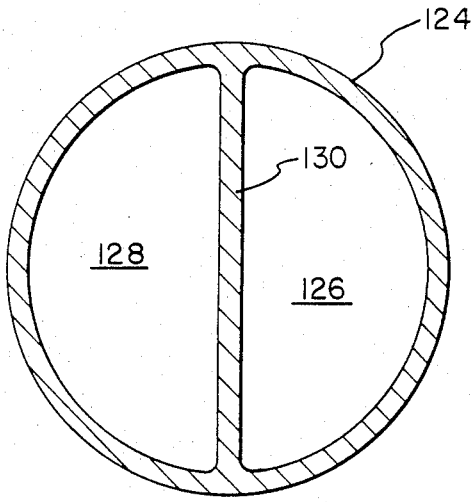
FIG. 13 is an enlarged view of the gaseous refrigerant conduit, in cross section, taken along line 13—13 of FIG. 8.

Continuing now with the description of baffle 60, and as best seen in FIGS. 3 and 6, an angled surface 70 is provided to form a smooth transition region from surface 62 to cylindrical wall 66. Cylindrical wall 66 is also joined by means of a gently sloped portion 73 to an arcuate spiralling surface 72 which merges smoothly with arcuate cylindrical wall 64. The shape of sloped portion 73 closely follows the shape of top end wall 14 so that inflowing fluid is forced to follow the desired spiralling path. Furthermore, the configuration of the upper surface of the baffle is such that refrigerant which enters liquid storage vessel 18 will be deflected from a substantially axial entry flow direction to a spiralling generally horizontal flow direction tangential to the inside wall of casing 12. Outwardly spiralling surface 72, forces the refrigerant to flow outwardly from the baffle 60 into annular space 68 between baffle 60 and the cylindrical wall of the casing 12.

Baffle 60 is also provided with a central aperture 74 through which extends fluid outlet 22. Fluid outlet 22 is press fit into upflow passage 34 so that refrigerant may flow out of vessel 18 through passages 34 and 36, outlet 22, and the central aperture 74 of baffle 60. As best seen in FIG. 6, baffle 60 also includes an aperture 76 for engaging with conduit 30. Conduit 30 engages a shoulder portion 78 of baffle 60 so that baffle 60 is supported by conduit 30 whereby the top edge 82 of baffle cylindrical wall 66 is securely engaged with and sealed to upper end cap 14. Furthermore, as described above, arcuate cylindrical wall 64 sealingly engages with the top end wall 14. Refrigerant entering vessel 18 is thus prevented from bypassing baffle 60 and is confined by the spiralling conduit defined by upper end wall 14, spiralling surface 62, arcuate wall 64, cylindrical wall 66 and spiralling surface 72. It should also be noted that openings 80 is provided in baffle 60 to accommodate vent passages 48.

Baffle 60 is preferably manufactured of a molded plastic material such as ULTEM 2300 manufactured by the General Electric of Mt. Vernon, Ind.

In operation, refrigerant flows into inlet 20, as shown by the arrow 84, is deflected by baffle 60 at sloping ramp entry portion 63 and will then be confined by the spiralling conduit formed by surface 62, walls 64, 66, and 72, and end wall 14 of casing 12. The refrigerant is forced to flow in a clockwise, substantially horizontal, spiralling movement. The refrigerant is confined by the spiralling conduit through an arc in the range of 130° to 170° before confinement is terminated by the termination of wall 64 at edge 65. Continuing in a clockwise direction, the refrigerant is guided further outwardly by baffle inner wall 72 which follows a gentle spiralling arc outwardly to meet the outer baffle wall 64 at the point of entry of the refrigerant into the vessel. The refrigerant which consists of both gaseous refrigerant and liquid refrigerant now enters the vessel liquid storage area by flowing through annular space 68 between baffle 60 and vessel wall 12. Thus, the inflowing refrigerant changes direction positively and smoothly from an axial vertical direction to a substantially horizontal circular direction along the casing wall with very little pressure drop. The refrigerant enters the liquid storage area with a spiralling movement close to the vessel wall in annular space 68 as shown by arrow 85, thereby causing the liquid refrigerant to be separated from the gaseous refrigerant by centrifugal force. The liquid refrigerant flows downwardly along or near the vessel wall in a spiralling or vortex manner until it joins the liquid in storage. The gaseous refrigerant, being less dense than the liquid refrigerant, will break away from the liquid refrigerant. Since baffle 60 is provided with a downwardly directed lip 90, the gaseous refrigerant will first flow upwardly in the vessel and then downwardly to enter the downflow passage 36 of conduit 30 as shown by arrows 86. The tortuous path which the gaseous refrigerant must follow to flow into passage 36 ensures that no liquid refrigerant will flow into conduit 30. The gaseous refrigerant will flow downwardly through passage 36 and will then turn through 180° in transition cap 38 and will thereafter flow upwardly through upflow passage 34 and out of outlet 22 as shown by arrows 88.

One significant advantage of the present invention is the relatively low pressure drop across baffle 60. By way of example, for a three inch diameter suction accumulator and at a high mass flow rate, the pressure drop across the baffle is approximately four (4) inches of water column. At a low mass flow rate, this pressure drop will be approximately one-half (0.5) inch of water column. The low pressure drop is due to the smooth manner in which the direction of flow of refrigerant is changed from an axial direction to the spiralling rotary motion. Furthermore, the cross sectional area of the confined conduit defined by baffle 60 and end wall 14 keeps functional losses to a minimum.

Another significant advantage of the invention is that the liquid which flows into vessel 18 from baffle 60 does not unduly disturb the liquid already in storage. The swirling entry of the inflowing liquid into the liquid storage vessel imparts a swirling-mixing motion to the liquid which is in storage. Thus, at low temperatures when certain oils tend to phase separate from liquid refrigerant, the liquid in storage tends to separate into a bottom refrigerant-rich liquid layer and a top oil-rich liquid layer. For example, R-22 refrigerant and naptheric base oil such as Suniso 3GS sold by Witco Company of New York, N.Y., will phase separate at about 34° under placid conditions. In this condition, the oil-rich layer will be above orifice 44 and will be unable to return to the compressor. Prolonged operation in this condition could trap sufficient compressor oil in the liquid storage vessel and could lead to compressor bearing failure. By providing a swirling motion to inflowing liquid flowing downwardly on or near the vessel wall, the liquid in storage is agitated or mixed sufficiently to maintain the liquid in storage as a homogeneous refrigerant and oil mixture. On the other hand, the swirling-spiralling motion of the entering liquid along or near the vessel wall does not disturb the liquid in storage sufficiently to cause splashing of the liquid into the downflow passage 34. This is very desirable, especially during a valve reversal mode of a heat pump system.

Referring now to FIGS. 8–13, another embodiment of the suction accumulator is shown. Corresponding parts have been indicated with corresponding reference numbers. A deflection baffle 100 is shown including a spiralling ramp 102 having an entry portion 101. A fin 104 is provided on ramp 102 for preventing relative rotation of baffle 100 with respect to inlet 20, as fin 104 abuts inlet 20. Thus, the inflowing refrigerant is confined by spiralling ramp 102, arcuate wall 110, cylindrical wall 106, and top end wall 14 and is deflected through substantially 90° into a spiralling flow. Arcuate wall 110 ends at end portion 112 so that the refrigerant will flow from spiralling arcuate surface 102 through space 68 and into vessel 18.

Baffle 100 is also provided with a cylindrical conduit portion 113 including an aperture 114 in the bottom walls 115 thereof. Furthermore, baffle 100 includes a conduit portion 118 which is shaped to conform to and fits inside of semi-cylindrical upflow passage 126 of a conduit 124. Conduit 118 may be secured to conduit 124 in any suitable manner as, for instance, with an adhesive. Conduit 124 includes a divider wall 130 to divide conduit 124 into a downflow passage 128 and an upflow passage 126.

Referring further to FIGS. 8–11, bottom wall 115 of cylindrical portion 113 including an equalizer vent passage 116. Furthermore, cylindrical wall 106 includes a bottom wall portion 120 to prevent refrigerant gas in vessel 18 from flowing upwardly and out of vessel 18.

Thus, in operation, the suction accumulator of FIGS. 8–13 is very similar to the operation of the accumulator of FIGS. 1–7. Refrigerant, including liquid and gaseous components, flows into inlet 20. The refrigerant is then deflected by baffle 100 at sloping ramp entry portion 101 and will then be confined by the spiralling conduit formed by ramp surface 102, arcuate wall 110, and cylindrical wall 106 and top end wall 114. As in the embodiment of FIGS. 1–7, the refrigerant is forced to flow in a clockwise, substantially horizontal, spiralling movement. As the refrigerant reaches end portion 112 of arcuate wall 110, the refrigerant flows from spiralling surface 102 through space 68 into vessel 18. Since baffle 100 is provided with a downwardly directed lip 132, gaseous refrigerant must first flow upwardly and then downwardly into downflow passage 128. This tortuous path ensures that no liquid refrigerant enters passage 128. Liquid refrigerant is separated out by centrifugal action and flows in a spiralling movement downwardly along the inside wall of casing 12 to join the liquid in storage.

Inlet 22 is received in cylindrical portion 113 and bottoms out on bottom wall 115 thereof. Vent 116, therefore, directly interconnects vessel 18 with outlet 22 to permit equalization of pressures in the suction accumulator when the compressor of the refrigeration system is shut off. This prevents liquid refrigerant from building up in upflow conduit 126 and thereby prevents "slugging" of the compressor upon startup.

What has therefore been provided is a very efficient and compact suction accumulator which is relatively inexpensive to manufacture and which includes molded or extruded plastic components.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A suction accumulator comprising:

a casing including first and second end walls and defining a fluid storage vessel;

a fluid inlet in said casing for establishing a fluid flow path into said casing; and a baffle disposed in said casing for defining with a surface of said casing an extension of said fluid flow path whereby fluid flowing into said casing through said fluid inlet is confined, said baffle deflecting said fluid to first flow tangentially along the wall of said casing and thereupon to enter said fluid storage vessel.

2. The suction accumulator of claim 1 including a first conduit axially disposed in said casing, said conduit having a first open end, said baffle and first conduit first open end arranged so that fluid flowing into said vessel follows a tortuous path to enter said first conduit first open end.

3. The suction accumulator according to claim 1 wherein said baffle is comprised of molded plastic material.

4. The suction accumulator of claim 2 including a fluid outlet in said first end wall, a second conduit in fluid flow communication with said first conduit and said fluid outlet, said baffle including a first aperture for defining a continuous fluid flow path from said second conduit through said first aperture to said fluid outlet.

5. The suction accumulator according to claim 4 wherein said baffle includes a second aperture for defining a direct fluid flow communication path between said fluid storage vessel and said fluid outlet.

6. The suction accumulator of claim 1 including a fluid outlet in said first end wall, and wherein said baffle is generally cylindrical, said baffle including a generally central passage for conducting fluid from said vessel to said fluid outlet.

7. The suction accumulator of claim 1 wherein said deflected fluid is separated into its liquid and gaseous components and wherein said liquid component flows along the wall of said casing in a generally spiralling path.

8. A suction accumulator comprising:

a generally cylindrical casing including first and second end walls and defining a fluid storage vessel;

a fluid inlet in said first end wall;

a fluid outlet in said first end wall;

a generally cylindrical baffle disposed within said casing for confining between said baffle and said first end wall fluid which flows into said casing through said inlet, said baffle deflecting said fluid as it enters said casing and defining a generally spiralling flow path whereby the direction of fluid flow is changed by said baffle from a flow direction generally parallel to the axis of said casing at said fluid inlet to a generally circular flow direction encircling the axis of said casing when said fluid flows from said baffle into said fluid storage vessel; and a first elongated conduit axially disposed in said casing, said first elongated conduit connected to a generally central portion of said baffle, said generally central portion including a first aperture whereby fluid flows from said vessel through said first elongated conduit and through said first aperture in said generally central portion of said baffle to said fluid outlet.

9. The suction accumulator of claim 8 wherein said deflected fluid is separated into its gaseous and liquid components and wherein said liquid component spirals downwardly along the wall of said cylindrical casing to join the liquid in storage in said vessel.

10. The suction accumulator of claim 9 wherein the separated gaseous fluid component flows downwardly from said baffle, then flows upwardly and finally flows downwardly to enter said first elongated conduit.

11. The suction accumulator of claim 8 wherein said generally spiralling flow path is defined by a generally arcuate outer wall of said baffle and a generally spiralling inner wall of said baffle.

12. The suction accumulator according to claim 8 wherein said baffle is comprised of molded plastic material.

13. The suction accumulator of claim 8 wherein said generally spiralling flow path for said fluid surrounds said fluid outlet.

14. The suction accumulator of claim 8 wherein said baffle includes a second aperture for defining a direct fluid flow communication path between said fluid storage vessel and said fluid outlet.

15. The suction accumulator of claim 8 wherein said baffle is generally cylindrical and includes a generally central passage which forms an extension of said first elongated conduit for conducting fluid from said first elongated conduit to said fluid outlet.

16. The suction accumulator of claim 8 including a second elongated conduit for conducting gaseous fluid from an upper portion of said fluid storage vessel to a bottom portion of said first elongated conduit whereby pressures in said storage vessel may be equalized with pressures in said fluid outlet.

17. A suction accumulator comprising:

a generally cylindrical casing including first and second end walls and defining a fluid storage vessel;

a fluid inlet and a fluid outlet in said first end wall;

an elongated conduit axially arranged in said casing and defining a downflow passage and an upflow passage, one end of said downflow passage being open to the interior of said vessel, said downflow and upflow passages being in fluid flow communication;

said upflow passage connected to said fluid outlet to establish a fluid flow path from the interior of said vessel to said outlet; and a baffle disposed in said casing, said baffle defining a confined fluid flow path with said first end wall, said baffle comprising a generally spiralling surface surrounding said fluid outlet, an arcuate upstanding outer wall and a spiralling inner wall, said baffle arranged to receive fluid flowing into said fluid inlet and to deflect said fluid to flow substantially horizontally and tangentially to the inside wall of said casing, at least a portion of said spiralling surface being spaced from said inner wall whereby said fluid flows from said baffle into said vessel.

18. The suction accumulator of claim 17 wherein fluid flowing from said baffle into said vessel first flows downwardly into said vessel, and then flows upwardly to enter the open end of said downflow passage.

19. The suction accumulator according to claim 17 wherein said arcuate upstanding outer wall extends through an arc in the range of 130° to 170°.

20. The suction accumulator according to claim 17 wherein said baffle is comprised of molded plastic material.

21. The suction accumulator according to claim 17 wherein the central portion of said baffle includes a passage for conducting fluid from said vessel to said fluid outlet.

22. The suction accumulator of claim 17 wherein said baffle includes a tubular portion for fluid flow connection with said upflow passage and said fluid outlet.

23. The suction accumulator of claim 17 wherein said baffle includes an aperture for defining a direct fluid flow communication path between said fluid storage vessel and said fluid outlet.

24. The suction accumulator of claim 17 wherein said elongated conduit includes a elongated pressure equalization passage for direct fluid flow communication of said fluid storage vessel with said upflow passage.

25. The suction accumulator of claim 17 wherein said deflected fluid is separated into its liquid and gaseous components and wherein said liquid component flows downwardly in a spiralling path along the wall of said cylindrical casing to join the liquid in storage in said storage vessel.

26. A method for separating a refrigerant fluid into its liquid and a gaseous components in a suction accumulator, said accumulator including a casing forming a fluid vessel, said casing having an inlet, an outlet, and a baffle disposed within said casing said method comprising:

directing refrigerant fluid through said inlet into said casing;

deflecting said fluid to flow in a substantially spiralling flow path and confining said fluid for at least a portion of said spiralling path as it flows along said baffle;

separating the fluid into a liquid component and a gaseous component;

collecting said liquid component; and providing a flow path for said separated gaseous component to said outlet.

27. The method of claim 26 wherein said separated gaseous component flows in a tortuous flow path through said vessel to said outlet.

28. The method of claim 26 wherein said separated liquid component flows in a spiralling flow path along or near said vessel wall and agitates the collected liquid in storage sufficiently so that it is maintained as a homogenous mixture.

* * * * *